US012329295B2

(12) United States Patent
Wu

(10) Patent No.: US 12,329,295 B2
(45) Date of Patent: Jun. 17, 2025

(54) GOODS PROPULSION APPARATUS WITH A REDUCER

(71) Applicant: Dongguan Yongsheng Spring Co., Ltd., Dongguan (CN)

(72) Inventor: Lilin Wu, Dongguan (CN)

(73) Assignee: Dongguan Yongsheng Spring Co., Ltd., Dongguan (CN)

( * ) Notice: Subject to any disclaimer, the term of this patent is extended or adjusted under 35 U.S.C. 154(b) by 0 days.

(21) Appl. No.: 18/411,198

(22) Filed: Jan. 12, 2024

(65) Prior Publication Data

US 2024/0188730 A1 Jun. 13, 2024

(51) Int. Cl.
*A47F 1/12* (2006.01)

(52) U.S. Cl.
CPC ..... *A47F 1/126* (2013.01)

(58) Field of Classification Search
CPC .... A47F 1/125; A47F 1/126; A47F 2010/025; A47F 5/005; G07F 11/42
See application file for complete search history.

(56) References Cited

U.S. PATENT DOCUMENTS 5,605,237 A * 2/1997 Richardson ..... A47F 1/126 211/59.3
5,634,564 A * 6/1997 Spamer ..... A47F 1/126 211/59.3
6,464,089 B1 * 10/2002 Rankin, VI ..... A47F 1/126 211/59.3
7,347,335 B2 * 3/2008 Rankin, VI ..... A47F 1/126 312/61

(Continued)

FOREIGN PATENT DOCUMENTS

DE 202013102529 U1 * 8/2013 ..... A47F 1/126
EP 2767192 A1 * 8/2014 ..... A47F 1/126

*Primary Examiner* — Patrick D Hawn

(74) *Attorney, Agent, or Firm* — MUNCY, GEISSLER, OLDS & LOWE, P.C.

(57) ABSTRACT

The utility model discloses a goods propulsion apparatus with a reducer, comprising a base, a push plate and a propulsion component, wherein the push plate is installed on the base, the propulsion component is arranged on the push plate for controlling the movement of the push plate, the outside of the push plate is provided with a decelerating mechanism, and the decelerating mechanism comprises a damper and a gear-rack component; the damper is installed on the side end of the push plate and extends with a rotating axis; the gear-rack component comprises a rotating wheel and a rack meshed with the rotating wheel, wherein the rotating wheel is arranged on one side of the damper and sleeved on the rotating axis, and the rack is arranged along the axial extension direction of the base; and the utility model has the advantages of simple structure, reasonable design and easy-to-use. The reducer composed of a damper and a gear-rack component can effectively slow down the movement speed of the propulsion apparatus, when the push plate is pushed forward, the gear on one side will move in a straight line along the rack, and the damper on the inner side of the gear can further make the propulsion apparatus slow down and move smoothly, so as to ensure the smooth delivery of goods to consumers.

8 Claims, 6 Drawing Sheets

(56) References Cited

U.S. PATENT DOCUMENTS

| | | | | |
|---|---|---|---|---|
| 7,458,473 | B1 * | 12/2008 | Mason | A47F 1/126 211/59.3 |
| 8,016,128 | B2 * | 9/2011 | Valiulis | A47F 1/126 211/59.3 |
| 8,190,289 | B2 * | 5/2012 | Lockwood | G07F 17/10 221/3 |
| 8,353,425 | B2 * | 1/2013 | Lockwood | G07F 9/002 221/227 |
| 8,646,650 | B2 * | 2/2014 | Lockwood | A47F 3/002 211/59.3 |
| 9,119,488 | B2 * | 9/2015 | Lockwood | G07G 3/003 |
| 9,265,362 | B2 * | 2/2016 | Hardy | A47F 1/125 |
| 10,154,739 | B2 * | 12/2018 | Turner | A47F 1/125 |
| 10,448,756 | B2 * | 10/2019 | Hardy | A47F 1/126 |
| 10,993,550 | B2 * | 5/2021 | Ewing | A47F 1/126 |
| 11,363,894 | B2 * | 6/2022 | Ewing | A47F 1/126 |
| 11,375,826 | B2 * | 7/2022 | Hardy | A47B 73/006 |
| 11,393,274 | B2 * | 7/2022 | Chang | G07F 11/38 |
| 11,627,818 | B2 * | 4/2023 | Hua | A47F 1/126 211/59.3 |
| D1,007,214 | S * | 12/2023 | Wu | D6/706 |
| D1,012,585 | S * | 1/2024 | Wu | D6/706 |
| 2006/0163272 | A1 * | 7/2006 | Gamble | A47F 1/126 221/227 |
| 2006/0237381 | A1 * | 10/2006 | Lockwood | A47F 1/126 211/59.3 |
| 2009/0084812 | A1 * | 4/2009 | Kirschner | A47F 1/126 221/1 |
| 2010/0059469 | A1 * | 3/2010 | Mason | A47F 1/126 221/199 |
| 2010/0147783 | A1 * | 6/2010 | Hardy | A47F 1/126 211/59.3 |
| 2014/0360953 | A1 * | 12/2014 | Pichel | A47F 1/04 211/59.3 |
| 2022/0133060 | A1 * | 5/2022 | Hua | A47F 1/126 211/59.3 |
| 2024/0138595 | A1 * | 5/2024 | Wu | A47F 1/126 |

* cited by examiner

GOODS PROPULSION APPARATUS WITH A REDUCER

TECHNICAL FIELD

The utility model relates to the technical field of goods propulsion apparatus, and specifically relates to a goods propulsion apparatus with a reducer.

BACKGROUND

Goods propulsion apparatus is an automatic display apparatus applied to retail shelves such as supermarkets, convenience stores, department stores and vending machines. The apparatus can replenish goods or push them out when the goods are out of stock or shipped, that is, when consumers need the current goods, the goods propulsion apparatus will push out the desired goods, making it convenient for consumers to pick them up.

Therefore, the applicant developed and applied for a utility model patent—goods propulsion apparatus, application No. 202222895212.3; and during the process of daily use, it is found that goods can be quickly delivered to the front of consumers due to the instantaneous resilience of the propulsion component. During the process of rapid propulsion, it is difficult to keep the goods in a balanced and stable state, causing them to fall off the propulsion apparatus, making it difficult to effectively push the goods to the front of consumers, and the fallen goods need to be taken away manually later, so it is necessary to arrange and maintain the propulsion apparatus.

Therefore, it is necessary to study a new technical solution to solve the above problems.

SUMMARY

In view of this, the main purpose of the utility model is to provide a goods propulsion apparatus with a reducer, in response to the shortcomings of the prior art.

In order to achieve the above purpose, the utility model adopts the following technical solution: A goods propulsion apparatus with a reducer, comprising a base, a push plate and a propulsion component, wherein the push plate is installed on the base, the propulsion component is arranged on the push plate for controlling the movement of the push plate, the outside of the push plate is provided with a decelerating mechanism, and the decelerating mechanism comprises a damper and a gear-rack component;

the damper is installed on the side end of the push plate and extends a rotating axis to one side to slow down the pushing speed of the push plate;

and the gear-rack component comprises a rotating wheel and a rack meshed with the rotating wheel, wherein the rotating wheel is arranged on one side of the damper and sleeved on the rotating axis, the rack is arranged along the axial extension direction of the base and placed inside the base, and the propulsion component controls the movement of the push plate, so that the rotating wheel can mesh and move along the rack and drive the damper to decelerate.

Preferably, the base is provided with a chute extending along its axial direction and the chute is arranged on one side of the rack.

Preferably, the push plate is slidably installed on the chute of the base, and the head of the base is provided with a protective fixing plate for pushing goods, the propulsion component controls the push plate to slide along the chute and makes the rotating wheel on one side to move back and forth in a straight line along the rack, and controls the pushed goods to move forward to the protective fixing plate.

Preferably, the left and right sides of the base are provided with upward extending fender brackets, and the fender brackets are used for preventing goods from falling during the pushing process.

Preferably, the fender brackets are detachably installed on the base.

Preferably, the propulsion component is a coil spring, a wire grip or a pushing spring, and has a resilience for elastic deformation.

Preferably, the two side ends of the base are provided with positioning installation blocks that protrude outward, and the positioning installation blocks are used for fastening and connecting with the fixed blocks of the apparatus.

Preferably, the push plate and the protective fixing plate are in an arc plate structure, and the arc plate structure of the push plate and the protective fixing plate is oppositely arranged for stable pushing and protecting goods.

Compared with the prior art, the utility model has apparent advantages and beneficial effects. Specifically, it can be seen from the above technical solution that: By adding a reducer to the original structure, the propulsion apparatus can play a role of slowing down during the process of pushing goods, allowing the goods to move forward slowly, maintaining the stability of the goods during the pushing process, and avoiding the situation of falling them out due to instability, thus making it difficult to effectively push the goods to the front of users. The utility model has the advantages of simple structure, reasonable design and easy-to-use. The reducer composed of a damper and a gear-rack component can effectively slow down the movement speed of the propulsion apparatus, when the push plate is pushed forward, the gear on one side will move in a straight line along the rack, and the damper on the inner side of the gear can further make the propulsion apparatus slow down and move forward smoothly, so as to ensure the smooth delivery of goods to consumers.

BRIEF DESCRIPTION OF THE DRAWINGS

In order to explain the technical solution in the embodiments of the application more distinctly, a brief introduction will be given below to the drawings required in the embodiments or the description of the prior art. Obviously, the drawings in the following description are only some embodiments of the application. For those ordinary technicians in the field, other drawings can be obtained according to these drawings without creative labor.

Figure 1:
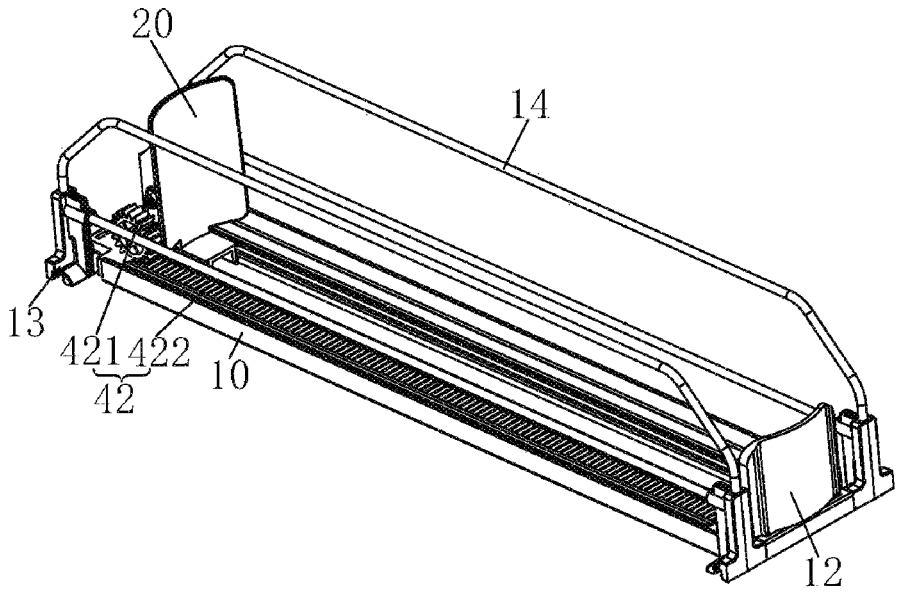
FIG. 1 is a schematic diagram of the overall structure of the utility model.

Reference numerals in the drawings are:

10. Base; 11. Chute; 12. Protective Fixing Plate; 13. Positioning Installation Block; 14. Fender Bracket; 20. Push Plate; 30. Propulsion Component; 40. Decelerating Mechanism; 41. Damper; 42. Gear-rack Component; 421. Rotating Wheel; 422. Rack.

DETAILED DESCRIPTION OF THE EMBODIMENTS

In order to make the technical problems, technical solutions and beneficial effects to be solved in the application more distinctly, the application will be further explained in detail below in combination with the drawings and embodiments. It should be understood that the specific embodiments described here are only used to explain the application and are not used to limit the application.

It should be noted that when a component is said to be "Fixed to" or "Arranged on" another component, it can be directly fixed to another component or indirectly arranged on that another component. When a component is said to be "Connected to" another component, it can be directly connected to another component or indirectly connected to that another component.

It should be understood that the terms such as "Length", "Width", "Up", "Down", "Front", "Back", "Left", "Right", "Vertical", "Horizontal", "Top", "Bottom", "Inside" and "Outside" that indicate the directions or positional relationships are based on the directions or positional relationships shown in the drawings, only for the convenience of describing the application and simplifying the description, and do not indicate or imply that the referred apparatus or components must have specific directions, be constructed and operated in specific directions, so they cannot be understood as limitations of the application.

In addition, the terms "First" and "Second" are only used to describe the purpose, and cannot be understood as indicating or implying relative importance or implicitly indicating the quantity of indicated technical features. Therefore, the features limited to "First" and "Second" can explicitly or implicitly include one or more of these features. In the description of the application, "Multiple" means two or more, unless otherwise specified.

In order to make the purpose, technical solutions and advantages of the utility model more distinctly, the utility model will be further explained in detail below in combination with the drawings and embodiments.

Figure 2:
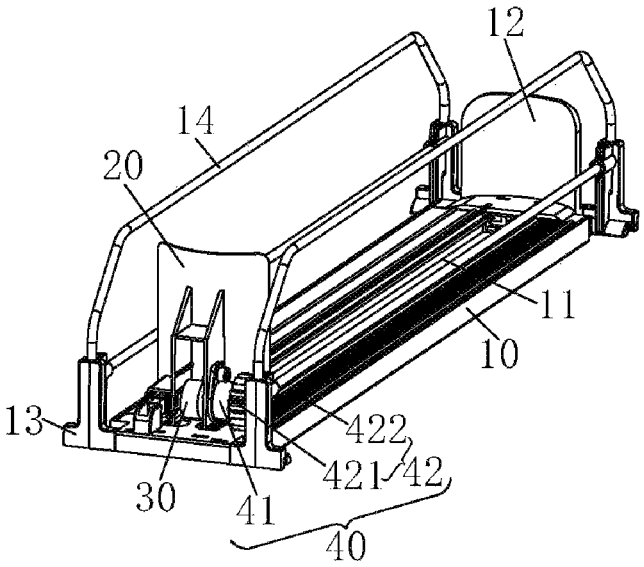
FIG. 2 is a schematic diagram of the overall structure of another perspective of the utility model.
Figure 3:
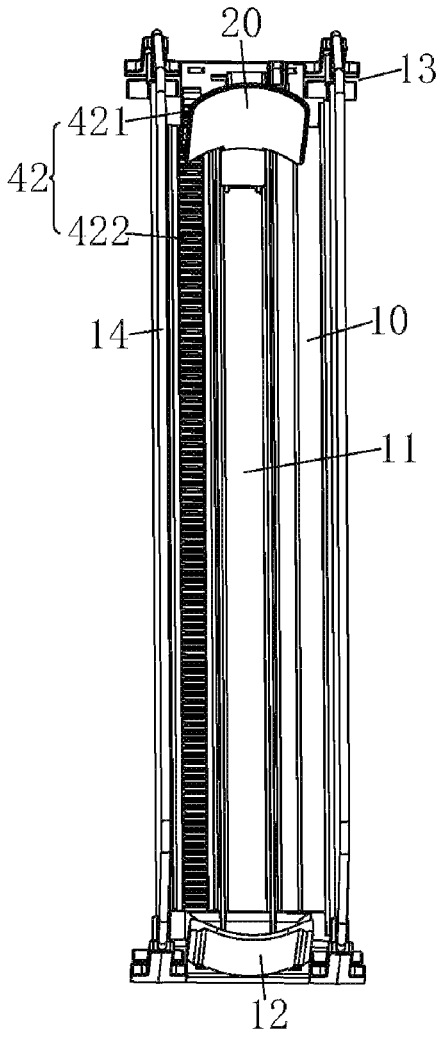
FIG. 3 is a schematic diagram of the top view structure of the utility model.
Figure 4:
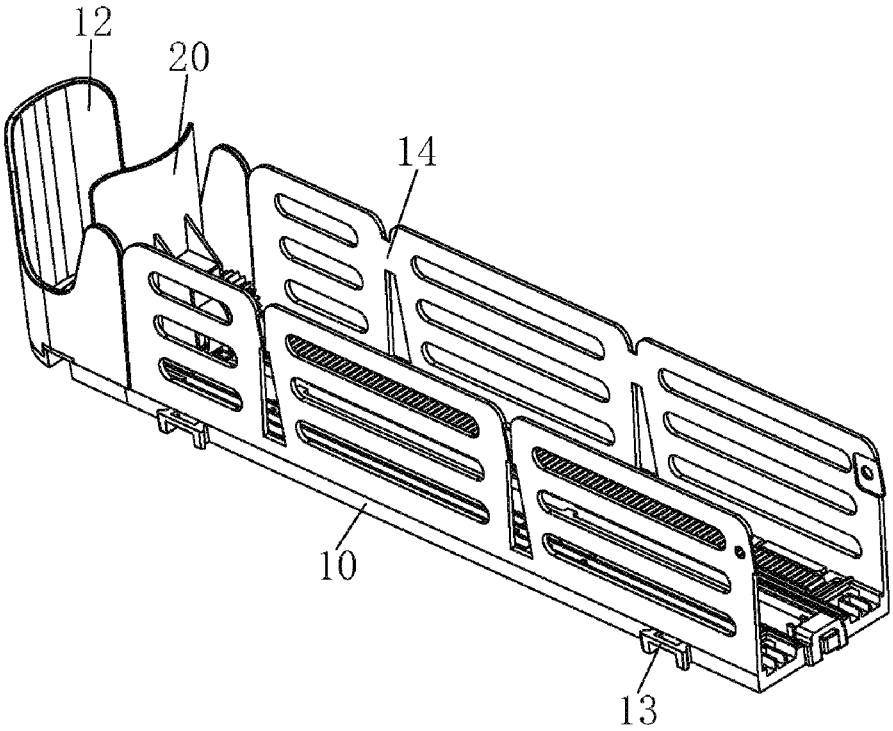
FIG. 4 is a schematic diagram of the structure of another goods propulsion apparatus of the utility model.
Figure 5:
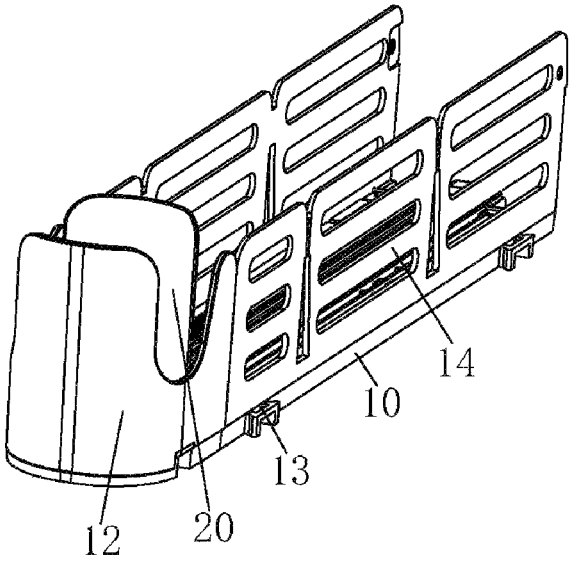
FIG. 5 is schematic diagram of the structure of another perspective of another goods propulsion apparatus of the utility model.
Figure 6:
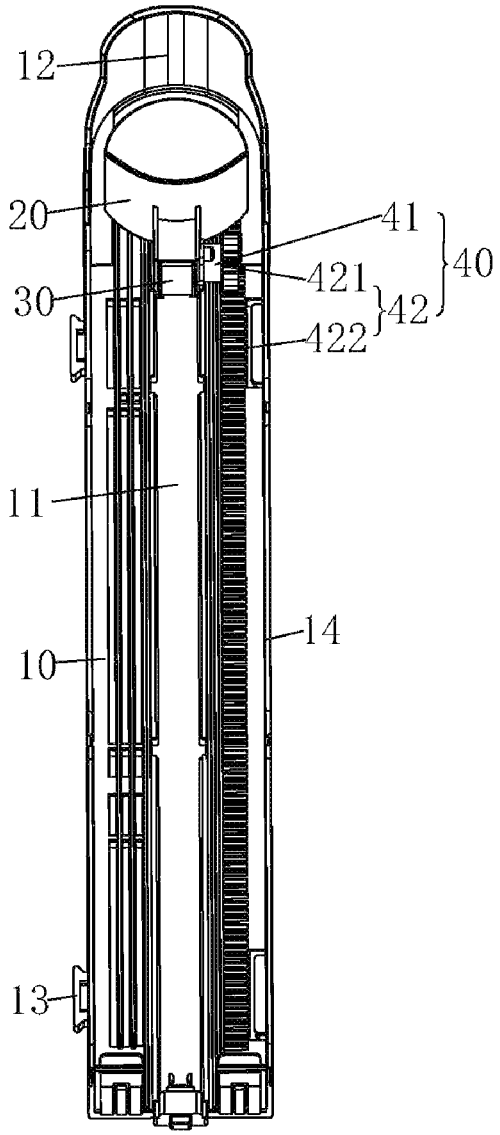
FIG. 6 is a schematic diagram of the top view structure of another goods propulsion apparatus of the utility model.

With reference to FIG. 1-6: A goods propulsion apparatus with a reducer, comprising a base 10, a push plate 20 and a propulsion component 30, wherein the push plate 20 is installed on the base 10, the propulsion component 30 is arranged on the push plate 20 for controlling the movement of the push plate 20, the outside of the push plate 20 is provided with a decelerating mechanism 40, and the decelerating mechanism 40 can effectively slow down and reduce the movement speed of the push plate 20, ensure the pushing stability of the goods, and avoid the situation that the goods fall out during the pushing process.

In the embodiment, the decelerating mechanism 40 comprises a damper 41 and a gear-rack 422 component 42, the damper 41 is installed on the side end of the push plate 20 and extends a rotating axis to one side, and is installed on the rotating axis through the gear-rack 422 component 42, which can slow down and reduce the pushing speed of the push plate 20, so that the goods on the push plate 20 and the upper end can move forward smoothly, and push them to the front of consumers.

Specifically, the gear-rack 422 component 42 comprises a rotating wheel 421 and a rack 422 meshed with the rotating wheel, wherein the rotating wheel 421 is arranged on one side of the damper 41 and sleeved on the rotating axis, and the rack 422 is arranged along the axial extension direction of the base 10 and placed inside the base 10. During use, when the propulsion component 30 controls the movement of the push plate 20, the rotating wheel 421 can mesh and move in a straight line along the rack 422, and drive the damper 41 to decelerate through the rotating wheel 421, thus further slowing down the movement speed of the push plate 20, and ensuring the stability and pushing effect of the push plate 20.

In the embodiment, the base 10 is provided with a chute 11 extending along its axial direction, and the push plate 20 is slidably installed on the chute 11 of the base 10, so that the push plate 20 can slide and move along the chute 11, and the chute 11 is arranged on one side of the rack 422.

Furthermore, the head of the base 10 is also provided with a protective fixing plate 12 for pushing goods. Specifically, when the propulsion component 30 controls the push plate 20 to slide and move along the chute 11, and makes the rotating wheel 421 on one side to move back and forth in a straight line along the rack 422, which can effectively reduce the movement speed of the push plate 20. Combined with the deceleration control of the damper 41, it can effectively control the speed of the push plate 20 when pushing goods forward, so as to safely and smoothly push the goods to the protective fixing plate 12. In addition, the inner side of the protective fixing plate 12 is provided with a buffer pad, and the buffer pad made of flexible materials can further offset the impact force generated by the pushing of goods, so as to better protect the goods, and the buffer pad can be rubber pad or buffer sponge.

In the embodiment, the left and right sides of the base 10 are provided with upward extending fender brackets 14, and the fender brackets 14 are detachably installed on the base 10, so that the goods can be prevented from falling down during the pushing process, and the fender brackets 14 with different heights and flexibilities can be replaced according to actual needs, so as to enhance the adaptability of the apparatus and expand the applicability of the apparatus.

In the embodiment, the propulsion component 30 is a coil spring, a wire grip or a pushing spring, and has a resilience for elastic deformation. When the push plate 20 moves backward, the propulsion component 30 will be elastically deformed along with the movement of the push plate 20. When the stop slot no longer clamps the stop block, the push plate 20 will slide forward under the elastic resilience of the propulsion component 30. Moreover, due to the decelerating effect of the decelerating mechanism 40, it can reduce the movement speed of the push plate 20, ensure the stability and safety of the goods, and avoid bouncing goods out due to the instantaneous elastic resilience, thus causing the loss of the goods.

In the embodiment, the two side ends of the base 10 are provided with positioning installation blocks 13 that protrude outward, and the positioning installation blocks 13 can be fastened and connected with the fixed blocks of the apparatus, so that the base 10 can be firmly installed on the display apparatus such as shelves and vending machines.

In the embodiment, the push plate 20 and the protective fixing plate 12 are in an arc plate structure, and the arc plate structure of the push plate 20 and the protective fixing plate 12 is oppositely arranged, in order to ensure good stability and protection of the goods during the pushing process and avoid breakage and other situations during the pushing process.

The above are only preferred embodiments of the utility model, and only the technical principles of the utility model are described in detail. These descriptions are only to explain the principles of the utility model, and cannot be interpreted in any way as limitations of the scope of protection of the utility model. According to the explanation here, any modifications, equivalent substitutions and improvements made within the spirit and principles of the utility model, as well as other specific embodiments of the utility model that can be associated by those technicians in the field without creative labor, should be included in the scope of protection of the utility model.

What is claimed is:

1. A goods propulsion apparatus with a reducer, comprising a base, a push plate and a propulsion component, wherein the push plate is installed on the base, the push plate comprises an installation plate including a first surface and a second surface opposite to the first surface, the propulsion component is arranged on the first surface of the installation plate of the push plate for controlling the movement of the push plate, wherein a decelerating mechanism is arranged on the second surface of the installation plate of the push plate, and the decelerating mechanism comprises a damper and a gear-rack component;

the damper is installed on the side end of the push plate and extends a rotating axis to one side to slow down the pushing speed of the push plate;

and the gear-rack component comprises a rotating wheel and a rack meshed with the rotating wheel, wherein the rotating wheel is arranged on one side of the damper and sleeved on the rotating axis, the rack is arranged along an extension direction of the base and placed inside the base, and the damper is deposited between the propulsion component and the rotating wheel along a direction of the rotating axis, the propulsion component controls the movement of the push plate, so that the rotating wheel can mesh and move along the rack and drive the damper to decelerate.

2. The goods propulsion apparatus with a reducer according to claim 1, wherein the base is provided with a chute extending along the extension direction of the base and the chute is arranged on one side of the rack.

3. The goods propulsion apparatus with a reducer according to claim 2, wherein the push plate is slidably installed on the chute of the base, and a head of the base is provided with a protective fixing plate for pushing goods, the propulsion component controls the push plate to slide along the chute and makes the rotating wheel on one side to move back and forth in a straight line along the rack, and controls the pushed goods to move forward to the protective fixing plate.

4. The goods propulsion apparatus with a reducer according to claim 1, wherein the left and right sides of the base are provided with upward extending fender brackets, and the fender brackets are used for preventing goods from falling during the pushing process.

5. The goods propulsion apparatus with a reducer according to claim 4, wherein the fender brackets are detachably installed on the base.

6. The goods propulsion apparatus with a reducer according to claim 1, wherein the propulsion component is a coil spring, a wire grip or a pushing spring, and has a resilience for elastic deformation.

7. The goods propulsion apparatus with a reducer according to claim 1, wherein the two side ends of the base are provided with positioning installation blocks that protrude outward, and the positioning installation blocks are used for fastening and connecting with fixed blocks of the apparatus.

8. The goods propulsion apparatus with a reducer according to claim 3, wherein the push plate and the protective fixing plate are in an arc plate structure, and the arc plate structure of the push plate and the protective fixing plate is oppositely arranged for stable pushing and protecting goods.

* * * * *